US008876577B2

(12) United States Patent
Lombard et al.

(10) Patent No.: US 8,876,577 B2
(45) Date of Patent: Nov. 4, 2014

(54) FLOOR FINISH REMOVAL AND CLEANING APPARATUS

(75) Inventors: James D. Lombard, Castle Rock, CO (US); James L. Young, Herriman, UT (US)

(73) Assignee: Karcher North America, Inc., Englewood, CO (US)

( * ) Notice: Subject to any disclaimer, the term of this patent is extended or adjusted under 35 U.S.C. 154(b) by 334 days.

(21) Appl. No.: 13/272,666

(22) Filed: Oct. 13, 2011

(65) Prior Publication Data

US 2012/0115401 A1 May 10, 2012

Related U.S. Application Data

(60) Provisional application No. 61/411,642, filed on Nov. 9, 2010.

(51) Int. Cl.

| | |
|---|---|
| ***B24B 23/00*** | (2006.01) |
| ***A47L 11/292*** | (2006.01) |
| ***B24B 7/18*** | (2006.01) |

(52) U.S. Cl.

CPC ..... *B24B 7/188* (2013.01); *A47L 11/292* (2013.01)

USPC ..... 451/353; 451/67; 451/352; 451/350; 15/52.1; 15/98

(58) Field of Classification Search

CPC ... A47L 11/145; A47L 11/161; A47L 11/206; A47L 11/4038; A47L 11/4041; A47L 27/0076; B24B 27/0076; B24B 23/024; B24B 29/00; B24B 55/102

USPC ..... 451/66, 67, 350, 352, 353, 456, 451/449–450; 15/52.1, 98

See application file for complete search history.

(56) References Cited

U.S. PATENT DOCUMENTS

| | | | | |
|---|---|---|---|---|
| 913,801 | A * | 3/1909 | Ansley | 15/98 |
| 1,550,052 | A * | 8/1925 | Anderson | 401/21 |
| 1,572,987 | A * | 2/1926 | Campbell | 15/98 |
| 1,812,771 | A * | 6/1931 | Blood et al. | 299/41.1 |

(Continued)

FOREIGN PATENT DOCUMENTS

| | | | | |
|---|---|---|---|---|
| DE | 3821559 | A1 * | 12/1989 | B24B 7/18 |
| DE | 19728380 | | 1/1999 | |

(Continued)

OTHER PUBLICATIONS

"2010 Karcher Commercial Floor Care Catalog," Karcher, Jan. 2010, 40 pages.

(Continued)

*Primary Examiner* — George Nguyen

(74) *Attorney, Agent, or Firm* — Sheridan Ross P.C.

(57) ABSTRACT

A floor care apparatus is provided that utilizes at least one cylindrical pad to remove a floor finish. More specifically, a cylindrical pad having an abrasive surface is integrated onto a cylindrical scrubber brush or associated core or roller commonly used in the art. The main outwardly-facing surface of the pad contacts the floor to remove a predetermined amount of floor finish wherein generated debris is expelled away from the pad. After finish removal, a new layer of finish is applied to the floor. Thus, the need to remove all finish layers from a flooring surface is alleviated, which saves time and money.

18 Claims, 3 Drawing Sheets

(56) References Cited

U.S. PATENT DOCUMENTS

| | | | | | |
|---|---|---|---|---|---|
| 2,534,969 | A | * | 12/1950 | Hauser | 451/352 |
| 2,689,367 | A | * | 9/1954 | Parker | 15/52.1 |
| 3,193,862 | A | * | 7/1965 | Lyon | 15/87 |
| 3,701,221 | A | * | 10/1972 | Vinella | 451/353 |
| 4,262,382 | A | * | 4/1981 | Brown et al. | 15/49.1 |
| 4,317,314 | A | * | 3/1982 | Carlstrom et al. | 451/353 |
| 4,523,361 | A | * | 6/1985 | Dummermuth | 29/81.05 |
| 4,570,278 | A | * | 2/1986 | Bloome et al. | 15/97.1 |
| 4,701,969 | A | * | 10/1987 | Berfield et al. | 15/79.1 |
| 4,724,567 | A | * | 2/1988 | Rones | 15/98 |
| 5,485,653 | A | | 1/1996 | Knowlton et al. | |
| 5,548,860 | A | * | 8/1996 | Weltikol et al. | 15/50.1 |
| 5,555,596 | A | | 9/1996 | Knowlton et al. | |
| 5,608,947 | A | | 3/1997 | Knowlton et al. | |
| 5,628,086 | A | | 5/1997 | Knowlton et al. | |
| 5,882,086 | A | * | 3/1999 | Bremner et al. | 299/41.1 |
| 5,890,954 | A | * | 4/1999 | Barous | 451/350 |
| 6,575,819 | B2 | * | 6/2003 | Beyersdorff | 451/352 |
| 6,645,263 | B2 | * | 11/2003 | Keipert et al. | 51/298 |
| 7,235,003 | B2 | * | 6/2007 | Thysell | 451/54 |
| 7,278,910 | B1 | * | 10/2007 | Jernigan | 451/350 |
| 7,533,435 | B2 | * | 5/2009 | Pedlar et al. | 15/49.1 |
| 2003/0066148 | A1 | * | 4/2003 | Pierce et al. | 15/49.1 |
| 2003/0192140 | A1 | * | 10/2003 | Guest | 15/49.1 |
| 2004/0226578 | A1 | | 11/2004 | Guest et al. | |
| 2004/0226584 | A1 | | 11/2004 | Guest et al. | |
| 2005/0250422 | A1 | * | 11/2005 | Thysell | 451/41 |
| 2006/0064844 | A1 | | 3/2006 | Venard et al. | |
| 2006/0124770 | A1 | | 6/2006 | Venard et al. | |
| 2006/0156498 | A1 | | 7/2006 | Venard et al. | |
| 2009/0094784 | A1 | | 4/2009 | Pedlar et al. | |
| 2010/0291843 | A1 | * | 11/2010 | Strickland | 451/350 |
| 2011/0023248 | A1 | | 2/2011 | Tucker et al. | |
| 2012/0096671 | A1 | | 4/2012 | Venard et al. | |

FOREIGN PATENT DOCUMENTS

| | | |
|---|---|---|
| EP | 0826333 | 3/1998 |
| EP | 1479336 | 11/2004 |
| EP | 1915236 | 4/2008 |
| WO | WO 2009/149722 | 12/2009 |

OTHER PUBLICATIONS

"EBG-20 Surface Preparation Machine," Square Scrub, 2010, 2 pages, found at http://www.squarescrub.com/product/ebg-20.

"Roller pads on sleeve, medium." Karcher, 2010, 1 page found at http://www.karcher.com/uk/Products/Professional/Scrubber_driers/Scrubber_driers_walk . . .

"BOOST® Technology." Clarke, 2010, 2 pages, found at htt://www.clarkeus.com/products/autoscrubbers/boost.aspx.

* cited by examiner

FLOOR FINISH REMOVAL AND CLEANING APPARATUS

This application claims the benefit of U.S. Provisional Patent Application Ser. No. 61/411,642, filed Nov. 9, 2010, the entire disclosure of which is incorporated by reference herein.

FIELD OF THE INVENTION

The present invention relates to a floor care apparatus. More specifically, one embodiment of the present invention is a floor care apparatus that employs at least one elongated cylindrical pad for scrubbing and/or removing finish from a floor.

BACKGROUND OF THE INVENTION

Floor care apparatus are used extensively for cleaning, scrubbing, burnishing, sanding, etc. floors comprised of tile, stone, brick, wood, concrete, carpet, etc. Floor care apparatus are generally comprised of a steerable chassis supported by a plurality of wheels. The chassis accommodates a cleaning assembly, such as a scrubber, a sweeper, a sander, a squeegee, a burnisher, etc. The chassis may also accommodate water tanks, cleaning solution tanks, and spent cleaning fluid that are suctioned from the surface being treated. Further, for dry cleaning or finish removal operations, the floor care apparatus may possess a vacuum system and a receptacle or bag for holding collected dust and debris. The majority of the components associated with the floor care apparatus are surrounded by a housing that protects the internal components and prevents individuals who are working around the apparatus from touching the often hot internal components thereof. As floor care apparatus are sometimes used in tight spaces, such as bathrooms and hallways, it is often desirable to make them as compact as possible.

Floors are often covered with a coating or "finish" material that resists wear. To maintain a desired appearance and level of protection, however, floors must be refinished from time-to-time. Initially, a chemical stripper is deposited onto the existing finish. The "loose" finish is then removed by a floor care apparatus that employs sanding pads that separate the finish and stripper from the floor. The floor must then be thoroughly cleaned and allowed to dry before receiving a fresh coat of finish. As one skilled in the art will appreciate, refinishing is a time consuming and a labor intensive process. In addition, the caustic nature of chemicals used and associated odor renders the working environment dangerous and unpleasant.

As briefly mentioned above, some refinishing processes are dry wherein stripping chemicals are omitted and disk-shaped brushes are employed to remove existing finish. Before a new coat of finish can be applied, however, the floor needs to be brought to an even, smooth, and scratch-free state, which is difficult to achieve with traditional disk scrubbers that are primarily designed to remove finish. Further, the apparatus and associated scrubbers used to clean floors do not function very well for finish removal, which is commonly performed using disk-shaped sanding pad. More specifically, some prior art machines employ disk-shaped scrubbers with attached sanding pads, which leave behind swirl marks and hard-to-reach areas, such as corners, untreated because of the shape of the sanding pads. Other apparatus allow the cylindrical scrubbing pads to be replaced by flat pads that move laterally for sanding and finish removal. Such pads work well initially but are prone to "clogging" by debris created by the sanding operation. As one of skill in the art will appreciate, clogged pad have less sanding surface area for contact with the floor.

Thus it has been along felt need to provide an apparatus that can be used to scrub and sand a floor that possesses long-lasting pads that efficiently remove floor finish without clogging.

SUMMARY OF THE INVENTION

It is one aspect of the present invention to provide a floor care apparatus (herein "apparatus") that removes floor finish. As one of skill in the art will appreciate, some floor scrubbing apparatus (designed for wet floor scrubbing or dry floor sweeping) employ elongated cylindrical brushes that rotate along an axis that is generally perpendicular to the direction of apparatus travel. Embodiments of the present invention employ elongated, cylindrical sanding pads, i.e., drum pads, instead of disk pads without compromising performance. As one of skill in the art will appreciate, the sanding surface of disk pads generally stays in contact with the floor and generated debris cannot escape and creates a barrier between the pad and the floor, which adversely affects pad performance. This drawback of pad clogging is addressed as debris is expelled from the rotating pad by way of centrifugal acceleration.

The sanding pads of one embodiment are attached to cylindrical cores or over cylindrically-shaped scrubbing brushes with the abrasive surface face outwardly. The cores and associated sanding pad are then installed into an apparatus traditionally used for scrubbing. Applying sanding pads to a cylindrical scrubber brush or to a core thus adds more functionality to scrubbing machines. Some apparatus of the prior art use a series of wafer pads, which are thicker than a disk, that are sandwiched side-by-side and positioned on an axle. The series of wafer pads are spun along the axis generally perpendicular to the direction of apparatus travel and engaged onto a floor to remove finish. This type of sanding system is inferior as the individual wafers may separate or wear at different rates, which will cause uneven sanding. The cylindrical pads of embodiments of the present invention do not suffer this drawback and thus last longer and wear more evenly.

The contemplated apparatus also employs a water spraying and recovery system that wets and removes debris and dust created by the sanding pads to leave the floor clean and dry without chemicals. The rotating motion of the brushes shed debris from the pads, thereby providing increased life to the pad material and a decreased incidence of clogging. Again, because the contemplated pads do not clog or clog to a lesser degree than traditional pads, the pad has an increased life span. In addition, the use of the pads reduces waste. More specifically, often traditional pads are prematurely discarded as operators believe them to be to worn to use when in fact, they are merely clogged. Further, some operators are too lazy or unwilling to remove and clean a clogged pad and simply replace a malfunctioning pad with a new one.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

To assist in the understanding of one embodiment of the present invention, the following list of components and reference numbers is provided below:

| # | Component |
|---|---|
| 2 | Floor care apparatus |
| 6 | Chassis |
| 10 | Front wheel |
| 14 | Rear wheels |
| 18 | Floor treating assembly |
| 22 | Pad |
| 22F | Front pad |
| 22R | Rear pad |
| 26 | Squeegee |
| 26F | Front squeegee |
| 26R | Rear squeegee |
| 30 | Handle |
| 34 | Motor housing |
| 38 | Core |
| 42 | Axle |
| 46 | Longitudinal axis |
| 50 | Cylinder |
| 54 | Edge |
| 58 | Outer edge |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
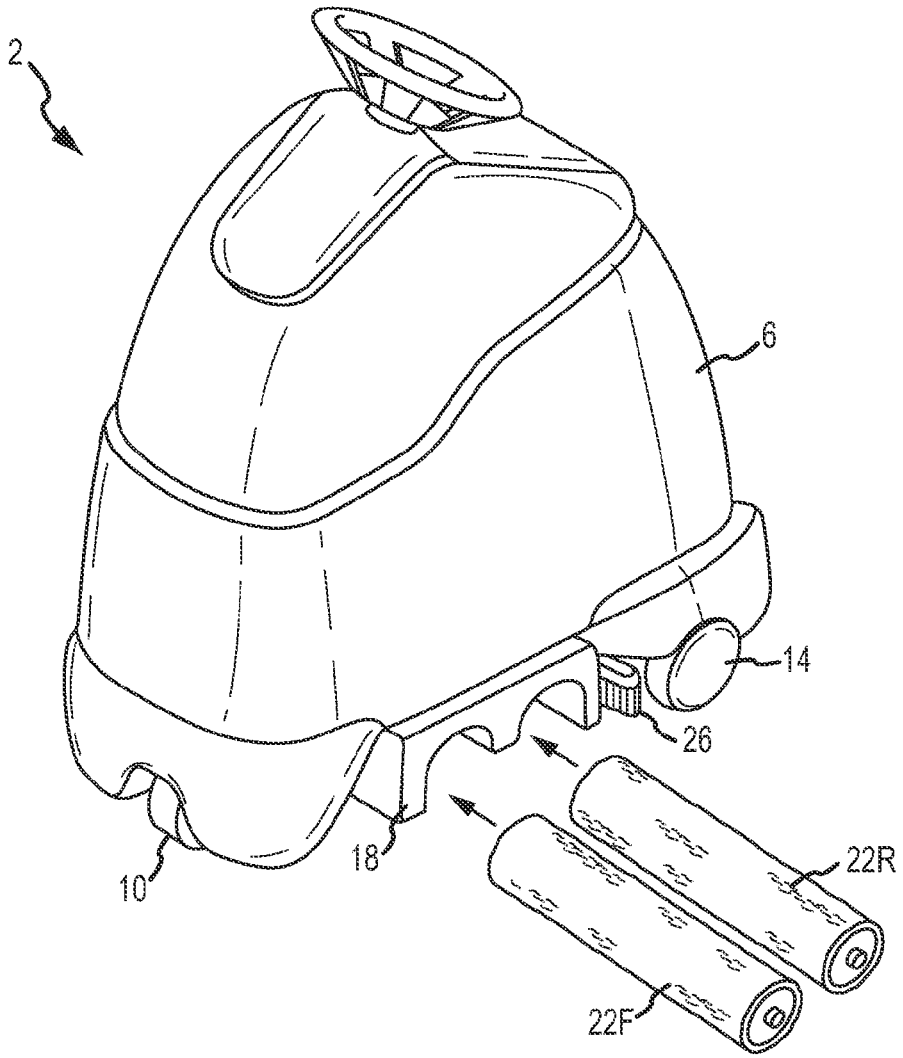
FIG. 1 is a perspective view of a floor care apparatus of one embodiment of the present invention.

FIG. 1 is a floor care apparatus 2 of one embodiment of the present invention that comprises a chassis 6 that supports a steerable front wheel 10 and a plurality of rear wheels 14. One of skill in the art will appreciate that the apparatus shown is traditionally used for floor scrubbing operations. The floor care apparatus of embodiments of the present invention, however, may also be used for finish removal and include a floor treating assembly 18 that houses at least one sanding pad 22. Although two pads 22 are shown, one of skill in the art will appreciate that any number of pads 22, or brushes, or any other type or combination of floor treating device known in the art may be employed. A broom or squeegee 26 is located behind the floor treating assembly 18 and in front of the rear wheels 14.

In one embodiment of the present invention, two pads 22 with a surface adapted for removing finish treatment are employed. Preferably, a 3M Scotch Brite® surface preparation pad is integrated into the brush or wrapped around a brush core of existing manufacturer, which will be described in further detail below with respect to FIG. 3. The pad 22 may be wrapped around the core in a spiral fashion as disclosed in WO 2009/149,722, which is incorporated by reference herein. In addition, core of one embodiment is interconnected to the floor cleaning apparatus by bearings as also disclosed in the '722 application. As mentioned above, the floor care apparatus comprises two pads 22 for removal of finish. In other embodiments of the present invention, however, a front pad 22F is adapted for removing layers of floor treatment while the rear pad 22R is used for scrubbing the floor to remove debris. The scrubbing pad or brush 22R may be cylindrical as shown or may be disk shaped and rotate along an axis perpendicular to the surface being cleaned. It should be understood that any cleaning device may be used in conjunction with the contemplated sanding pad 22. One skilled in the art will further appreciate that any of the features disclosed in the references listed below may be used with the floor care apparatus without departing from the scope of the invention. For example, the floor care apparatus shown may be either walk-behind or ride-on.

The chassis 6 includes a tank of water cleaning solution that is mixed with cleaning solution or premixed, such as soap water, and a recovery tank. As the floor care apparatus 2 traverses the floor, the front brush 22F sands the floor to remove a layer or layers of finish of predetermined thickness. Nozzles located behind the front brush 22F spray water or cleaning solution on the sanded floor capture the dust and debris generated by the front brush 22F. The second brush 22R uses the cleaning solution to scrub the floor and a squeegee 26, or any other fluid capturing device, and suctioning system to direct the dirty solution and debris into a recovery tank. Additional nozzles positioned in front of the sanding brush 22F may be used that spray chemical or other finish softening agents to the floor. Still other embodiments of the present invention may be completely dry wherein a plurality of sanding brushes are used and debris is collected by a broom and vacuum system.

Figure 2:
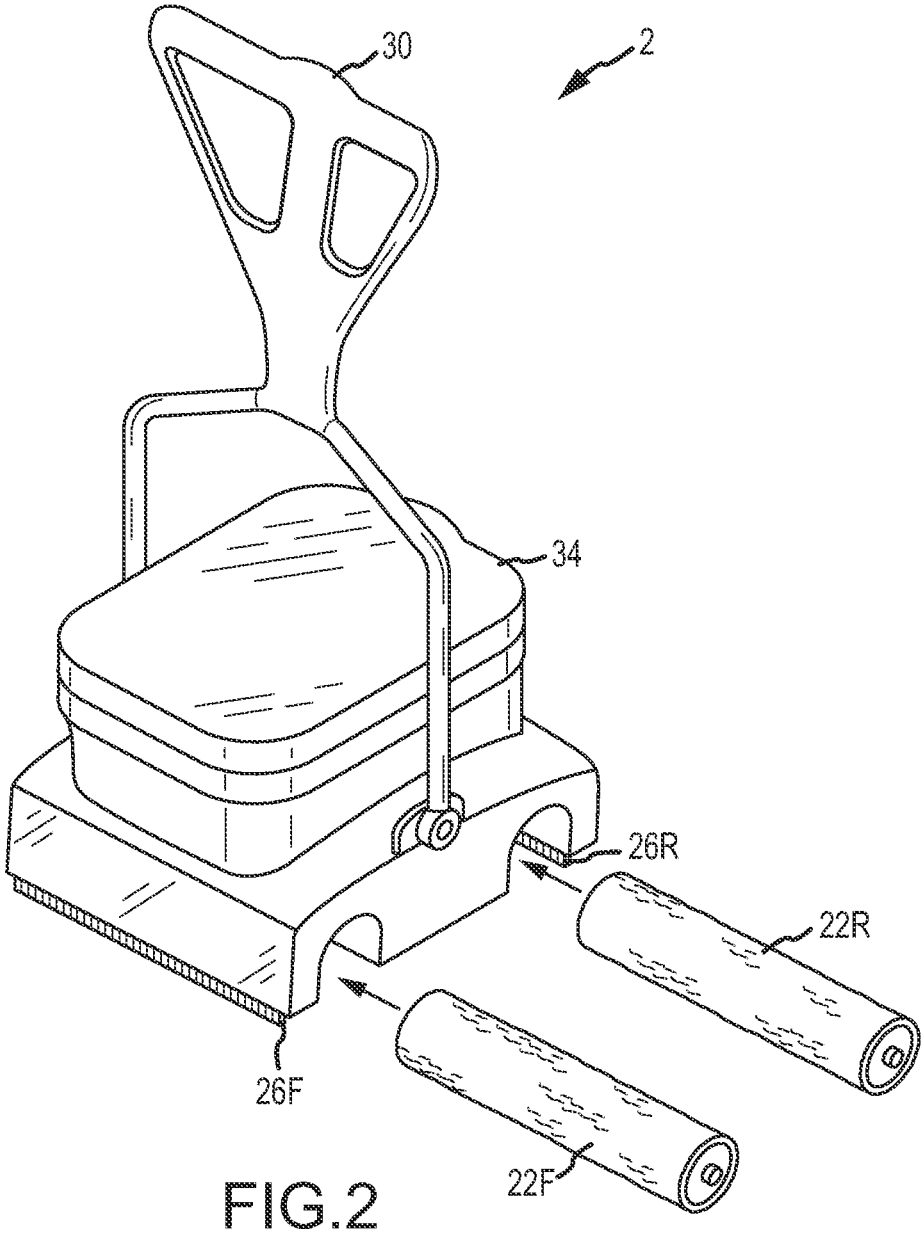
FIG. 2 is a perspective view of a floor care apparatus of another embodiment of the present invention.

Referring now to FIG. 2, a smaller walk-behind floor care apparatus 2 is shown that is controlled via a rotatable handle 30 interconnected to a motor and solution housing 34. A plurality of sanding pads 22 are located under the motor and are urged against the floor by the weight of the motor. This embodiment of the present invention is primarily used for wet finish removal operations wherein two pads 22 counter rotate which allows the apparatus to "float" and thus be more controllable. The weight of the gas or electrically powered motor, cleaning solution, and associated components will dictate the amount of force applied by the brushes, and, thus, the amount of finish removed. The apparatus also includes a squeegee 26F ahead of the front brush 22F and a squeegee rear 26R of the rear brush 22R that collect cleaning solution and debris from the floor. Using two squeegees also allows the apparatus to be used in two directions. A series of wheels or other propelling mechanisms may be incorporated into the floor treating apparatus to provide a propulsion.

Figure 3:
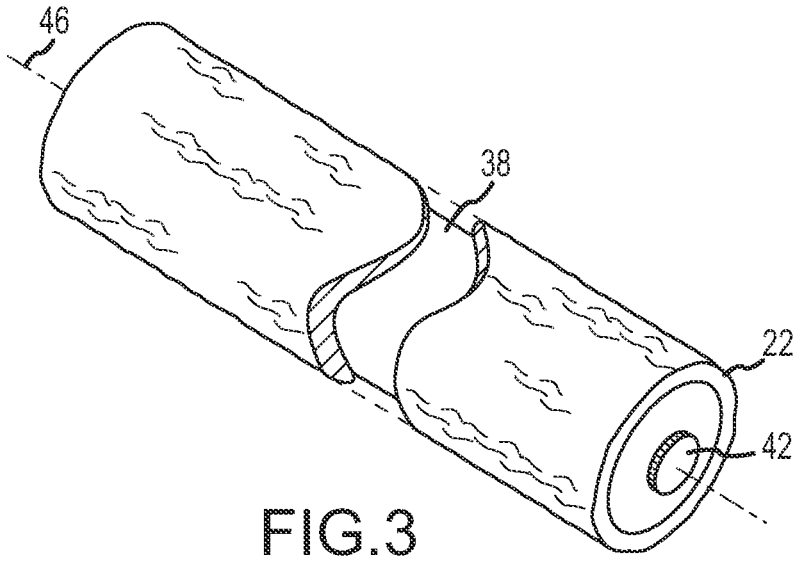
FIG. 3 is a perspective view of a pad used in conjunction with some embodiments of the present invention.

Referring now to FIG. 3, a pad employed by some embodiments of the present invention is shown that wrapped around a core 38 that is associated with an axle 42. The axle 42 rotates around a longitudinal axis 46 that is positioned generally parallel to the surface being cleaned and perpendicular to the direction of floor care apparatus travel. The pad 22 may be firmly associated with the core 38 or may be selectively removable therefrom. Further, the pad 22 may be formed in a single piece that is wrapped around the core 42 or may be of a clam shell configuration comprising two or more interconnected or closely associated pieces that extend the width of the core 38. The pad 22 may alternatively be slip fit onto the core 38.

Figure 4:
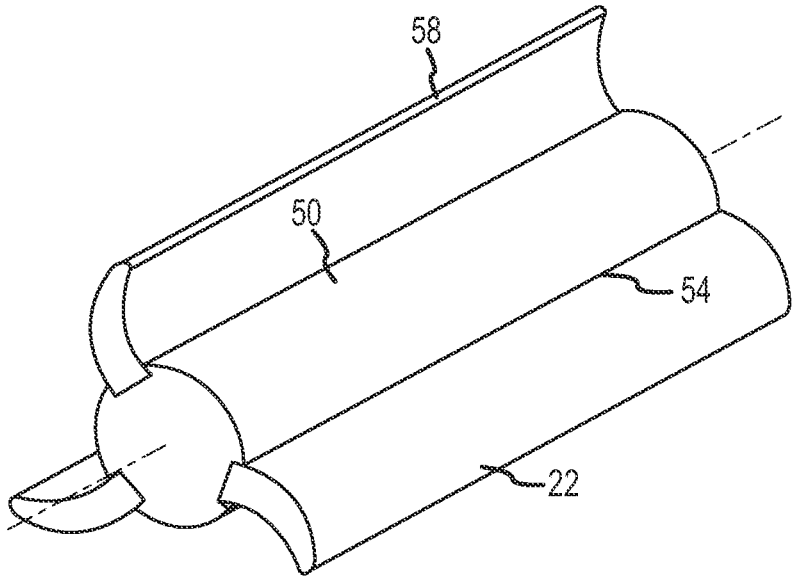
FIG. 4 is a perspective view of a pad comprised of a plurality of sanding pads operably interconnected to a core.

FIG. 4 shows another embodiment of the pad that includes a flap cylinder 50 with a plurality of pads 22 operatively interconnected thereto. One edge 54 of the pad 22 is associated with the cylinder 50 and the outer edge 58 of the pad 22 is located outwardly from the core. Although shown with a continuous external surface, one skilled in the art will appreciate that the pad may have a varied external pattern to facilitate removal of debris from the floor and expulsion of dust and debris from the pad material to prevent clogging.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

This application is related to U.S. Pat. No. 5,555,596, entitled "Floor Cleaning Apparatus"; U.S. Pat. No. 5,485,653, entitled "Floor Cleaning Apparatus"; U.S. Pat. No. 5,628,086, entitled "Floor Cleaning Apparatus with Squeegee Mounting System"; and U.S. Pat. No. 5,608,947, entitled "Floor Cleaning Apparatus with Pre-Filter"; the entire disclosures of which are incorporated by reference herein. This application is also related to U.S. patent application Ser. No. 11/059,663, filed Feb. 15, 2005, now U.S. Pat. No. 7,533,435, which is a Continuation-In-Part of U.S. patent application Ser. No. 10/737,027, filed Dec. 15, 2003, now abandoned, which is a Continuation-In-Part of U.S. patent application Ser. No. 10/438,485, filed May 14, 2003, now abandoned, the entire disclosures of which are incorporated by reference in their entirety herein. This application is also related to U.S. Patent Application Publication Nos. 2009/0094784, 2006/0064844, 2006/0124770, and 2006/0156498, and U.S. Patent Application No. 2011/0023248, the entire disclosures of which are incorporated by reference herein. This application is also related to pending U.S. patent application Ser. No. 12/912,554, filed Oct. 26, 2010, the entire disclosure of which is incorporated by reference herein.

What is claimed is:

1. A floor treating apparatus for removing a floor finish, comprising:

a chassis;

a front wheel and a rear wheel;

a floor treating assembly disposed between the front wheel and the rear wheel;

a collection device positioned behind the floor treating assembly;

wherein the front wheel, the rear wheel, the floor treatment assembly, and the collection device is provided on and/or under the chassis; and the floor treating assembly comprising a first rotating pad and a second rotating pad, the first rotating pad comprising a floor treatment removal pad and the second rotating pad comprising a scrubbing pad;

wherein at least one of the first rotating pad and the second rotating pad comprises a rotating non-woven, cellular-type, synthetic abrasive pad.

2. The floor treating apparatus of claim 1, wherein the first rotating pad being a non-woven, cellular-type, synthetic abrasive pad substantially parallel to the second rotating pad and the first rotating pad positioned between the front wheel and the second rotating pad.

3. The floor treating apparatus of claim 1, wherein at least one rotating pad comprises an elongate substantially cylindrical pad rotatable about a substantially horizontal axis.

4. The floor treating apparatus of claim 1, wherein the chassis further supports the weight of a user.

5. The floor treating apparatus of claim 1, further comprising a rotatable handle for user-manipulation of the floor-treatment apparatus.

6. A floor treating apparatus for removing a floor finish, comprising:

a chassis assembly;

a front wheel and a plurality of rear wheels;

a floor treating assembly disposed on a lower portion of the chassis and between the front wheel and the rear wheels, the floor treating assembly comprising a first roller and a second roller, the first and second rollers rotatable about an axis substantially parallel to a surface to be treated, and the first and second rollers being substantially parallel to each other;

the first roller adapted for removing floor treatment materials and comprising a non-woven, cellular-type, synthetic abrasive pad wrapped around the pad in a spiral fashion;

the second roller comprising a scrubber for removing debris from the floor;

a collection system provided between the second roller and the rear wheels, the collection system comprising a squeegee;

wherein the front wheel, the rear wheels, the floor treating assembly, and the collection system are contained on the chassis assembly.

7. The floor treating apparatus of claim 6, wherein at least one of the first roller and the second roller comprises a substantially cylindrical body with a plurality of pads extending arcuately therefrom.

8. The floor treating apparatus of claim 6, the apparatus further comprising a plurality of fluid-dispensing nozzles provided behind the first roller.

9. The floor treating apparatus of claim 6, wherein the chassis further supports the weight of a user and the apparatus comprises a ride-on apparatus.

10. The floor treating apparatus of claim 6, further comprising a rotatable handle for user-manipulation of the floor-treatment apparatus.

11. The floor treating apparatus of claim 6, wherein at least one of the wheels provides propulsion force to the apparatus.

12. The floor treating apparatus of claim 6, further comprising a first squeegee and a second squeegee, wherein the first squeegee is provided between the first roller and the front wheel and the second squeegee is provided between the second roller and the rear wheels.

13. The floor treating apparatus of claim 6, wherein the first roller comprises a sanding pad.

14. The floor treating apparatus of claim 7, wherein at least one of the plurality of pads comprises a sanding pad.

15. The floor treating apparatus of claim 6, wherein the first roller comprises a non-abrasive core associated with an axle, the non-abrasive core further comprising a sanding pad.

16. The floor treating apparatus of claim 15, wherein the sanding pad comprises a removable sanding pad.

17. A floor treating apparatus for removing a floor finish, comprising:

a chassis;

a front wheel and a rear wheel;

a floor treating assembly disposed between the front wheel and the rear wheel;

a means for collecting debris positioned behind the floor treating assembly;

wherein the front wheel, the rear wheel, the floor treatment assembly, and the means for collecting debris are contained on the chassis;

wherein the floor treating assembly comprises a first rotating pad and a second rotating pad, the first rotating pad being a non-woven, cellular-type, synthetic abrasive pad substantially parallel to the second rotating pad and the first rotating pad positioned between the front wheel and the second rotating pad.

18. A floor treating apparatus for removing a floor finish, comprising:

a chassis;

a floor treating assembly disposed on the chassis;

a collection device positioned behind the floor treating assembly;

the floor treatment assembly and the collection device for collecting debris contained on the chassis; and the floor treating assembly comprising a first rotating pad and a second rotating pad, the first rotating pad comprising a floor treatment removal pad and the second rotating pad comprising a scrubbing pad;

wherein at least one of the first rotating pad and the second rotating pad comprises a rotating non-woven, cellular-type, synthetic abrasive pad.

* * * * *